US007721626B2

(12) United States Patent
Obama et al.

(10) Patent No.: US 7,721,626 B2
(45) Date of Patent: May 25, 2010

(54) FUSE PULLER

(75) Inventors: Norihiro Obama, Utsunomiya (JP); Hiroyasu Furuya, Kakegawa (JP); Tatsuya Inaba, Kakegawa (JP); Masahiro Kawazu, Kakegawa (JP); Junpei Kitagawa, Kakegawa (JP); Toshihisa Yagi, Kakegawa (JP)

(73) Assignees: Honda Motor Co., Ltd., Tokyo (JP); Yazaki Corporation, Shizuoka (JP)

( * ) Notice: Subject to any disclaimer, the term of this patent is extended or adjusted under 35 U.S.C. 154(b) by 0 days.

(21) Appl. No.: 12/175,140

(22) Filed: Jul. 17, 2008

(65) Prior Publication Data

US 2009/0019971 A1 Jan. 22, 2009

(30) Foreign Application Priority Data

Jul. 19, 2007 (JP) ..... 2007-188242

(51) Int. Cl.
*B25B 27/14* (2006.01)

(52) U.S. Cl. ..... 81/3.8

(58) Field of Classification Search ..... 81/3.8; 294/99.1, 99.2

See application file for complete search history.

(56) References Cited

U.S. PATENT DOCUMENTS

| | | | | | |
|---|---|---|---|---|---|
| 1,481,517 | A * | 1/1924 | Kurz | 81/3.8 |
| 2,236,941 | A * | 4/1941 | Foley | 81/3.8 |
| 3,161,085 | A * | 12/1964 | Pratt | 81/3.8 |
| 3,215,006 | A * | 11/1965 | Urani | 81/3.8 |
| 4,841,819 | A * | 6/1989 | Williams | 81/3.8 |
| 5,267,493 | A * | 12/1993 | Yamagata et al. | 81/3.8 |
| 5,588,341 | A * | 12/1996 | Higuchi | 81/3.8 |
| 5,662,496 | A * | 9/1997 | Kanamori | 439/620.27 |
| 5,666,865 | A * | 9/1997 | Ito | 81/3.8 |
| 6,871,567 | B2 * | 3/2005 | Pinana Lopez | 81/3.8 |
| 7,384,086 | B2 * | 6/2008 | Lukaszynski et al. | 294/99.2 |
| 2002/0025700 | A1 | 2/2002 | Higashida et al. | |
| 2007/0141923 | A1 | 6/2007 | Rauscher et al. | |

FOREIGN PATENT DOCUMENTS

| | | | |
|---|---|---|---|
| GB | 2 262 667 | A | 6/1996 |
| JP | 5-342979 | A | 12/1993 |
| JP | 7-302537 | A | 11/1995 |
| JP | 11-102635 | A | 4/1999 |
| JP | 2006-304434 | A | 11/2006 |
| WO | WO 99/36930 | A1 | 7/1999 |

* cited by examiner

*Primary Examiner*—David B Thomas
(74) *Attorney, Agent, or Firm*—Arent Fox LLP

(57) ABSTRACT

A fuse puller is provided with a base component, and extracts a first fuse that is fitted in a first housing portion of a fuse box. The base component includes a first holding portion that is provided on one side of the base component and holds the first fuse inside the first housing portion, a gripping portion that is provided on the other side of the base component, and a second holding portion that holds a second fuse.

3 Claims, 18 Drawing Sheets

FUSE PULLER

BACKGROUND OF THE INVENTION

Priority is claimed on Japanese Patent Application No. 2007-188242, filed Jul. 19, 2007, the contents of which are incorporated herein by reference.

FIELD OF THE INVENTION

The present invention relates to a fuse puller.

DESCRIPTION OF RELATED ART

In conventional vehicle manufacturing, after inspections such as electrical diagnoses of various on-board instruments that are mounted inside a vehicle have been performed, the vehicle is delivered to a dealer. Generally, some on-board instruments provided in the vehicle such as clocks or interior lights are supplied with electricity from a continuous power supply irrespective of the operating position of the ignition switch (these are referred to below as 'continuous operation on-board instruments'). Because of this, dark current continues to flow in these continuous operation on-board instruments if the vehicle is stored for an extended period after the post-manufacturing vehicle inspection, and by the time the vehicle is delivered to a dealer, the power in the battery has all been used and the battery has become what is known as a dead battery.

To counter this, technology is known in which a fuse (i.e., a dark current fuse) is inserted along on the wiring that connects the continuous operation on-board instruments to the power supply. After the inspections have ended, an inspector removes the dark current fuse. The fuse is installed again at the dealers when the vehicle has been sold and is being readied for delivery.

A fuse box in which a dark current fuse is mounted is located below the vehicle interior instrument panel. Because of this, it is difficult for an inspector on an inspection line to extract the dark current fuse from the fuse box. Therefore, technology has been developed to melt and break the dark current fuse after the inspections have ended (see, for example, Japanese Unexamined Patent Application, First Publication No. 2006-304434). This melting of the dark current fuse can be easily achieved by installing a melting coupler on a connector that extends from the fuse box.

However, in the above-described technology, it is necessary at the dealers to perform a task of extracting the old melted fuse and a task of inserting a new replacement fuse. Specifically, the old fuse that is fitted in a first housing portion in the fuse box is held and extracted using a fuse puller which is fitted as standard in old fuse box, and this old fuse is then discarded. Next, the new fuse that has been fitted in a second housing portion is held and extracted using the fuse puller and is then inserted into the first housing portion. In this manner, the task of replacing the fuse is complicated, and there is a possibility of mistaking the positions of the first housing portion and the second housing portion.

As in the technology described in Japanese Unexamined Patent Application, First Publication No. 2006-304434, if a parallel housing portion that is electrically connected in parallel to the first housing portion is provided, then it is only necessary to insert the new fuse in the parallel housing portion and there is no need to extract the old fuse from the first housing portion. However, if the old melted fuse is left in the fuse box, there is a possibility that this will cause anxiety to a user of the vehicle so that, accordingly, it is desirable for the old fuse to be extracted from the fuse box.

Therefore, it is an object of the present invention to provide a fuse puller that makes it possible to replace a fuse easily and reliably.

SUMMARY OF THE INVENTION

The present invention employs the followings in order to achieve the above described object.

Namely, the fuse puller of the present invention is a fuse puller that is provided with a base component, and that extracts a first fuse that is fitted in a first housing portion of a fuse box wherein the base component includes: a first holding portion that is provided on one side of the base component and holds the first fuse inside the first housing portion; a gripping portion that is provided on the other side of the base component; and a second holding portion that holds a second fuse.

According to the above described fuse puller, because the gripping portion is provided, it is possible to perform a fuse replacement task without using a tool or the like. Moreover, by installing the fuse puller in advance on the first fuse, it is possible to accurately extract the first fuse from among the plurality of fuses that are fitted in the fuse box. Furthermore, because it is possible to hold the second fuse in the second holding portion, the second fuse can be accurately selected and used to replace the first fuse.

It is also possible for the second holding portion to be formed in the gripping portion.

In this case, because it is not necessary to provide the second holding portion separately from the gripping portion, it is possible to reduce the required space.

It is also possible to employ a structure in which the second holding portion is capable of inserting the second fuse into the first housing portion of the fuse box, and in which the second fuse is detachably provided in the second holding portion, and in which the holding force with which the second fuse is held by the second holding portion is smaller than the holding force with which the second fuse is held in the first housing portion.

In this case, because the second fuse is provided in the second holding portion such that it is able to be detachably, the first fuse can be easily extracted from the fuse box together with the fuse puller. The second fuse is then inserted into the first housing portion using the fuse puller, and the fuse puller is then separated from the second fuse. As a result, it is possible to replace the first fuse which is housed in the first housing portion with the second fuse. In this manner, the task of replacing a fuse can be performed easily and reliably.

Moreover, the holding force with which the second fuse is held by the second holding portion is smaller than the holding force with which the second fuse is held in the first housing portion. As a result, it becomes possible to separate the fuse puller from the second fuse simply by extracting the fuse puller after the second fuse has been inserted into the first housing portion using the fuse puller. Accordingly, the task of replacing a fuse can be performed easily and reliably.

It is also possible for the second holding portion to be provided in parallel with the first holding portion on the one side of the base component.

In this case, because the second fuse is held on one side (i.e., the fuse box side) of the base component, it is possible to prevent the second fuse falling out.

It is also possible for engaging portions that hold the second fuse that is housed in the second housing portion of the fuse box to be formed on the second holding portion.

In this case, because engaging portions are formed on the second holding portion, it becomes easy to extract the first fuse and the second fuse from the fuse box together with the fuse puller. The fuse puller is then rotated 180 degrees within a horizontal plane, the second fuse is then inserted into the first housing portion by the fuse puller, and the fuse puller is then separated from the second fuse. As a result, it is possible to replace the first fuse which is housed in the first housing portion with the second fuse. In this manner, the task of replacing a fuse can be performed easily and reliably.

It is also possible to employ a structure in which the holding force with which the first fuse is held by the first holding portion is greater than the holding force with which the first fuse is held in the first housing portion, and in which the holding force with which the second fuse is held by the second holding portion is greater than the holding force with which the second fuse is held in the second housing portion, and is also smaller than the holding force with which the second fuse is held in the first housing portion.

In this case, the holding force with which the first fuse is held by the first holding portion is greater than the holding force with which the first fuse is held in the first housing portion, and the holding force with which the second fuse is held by the second holding portion is greater than the holding force with which the second fuse is held in the second housing portion. As a result, it is possible to extract the first fuse and the second fuse from the fuse box together with the fuse puller.

Moreover, the holding force with which the second fuse is held by the second holding portion is also smaller than the holding force with which the second fuse is held in the first housing portion. As a result, it becomes possible to separate the fuse puller from the second fuse simply by extracting the fuse puller after the second fuse has been inserted into the first housing portion using the fuse puller. Accordingly, the task of replacing a fuse can be performed easily and reliably.

By employing the above described structure, the holding force with which the first fuse is held by the first holding portion of the fuse puller is greater than the holding force with which the second fuse is held in the second housing portion of the fuse box. Because of this, at the same time as the fuse puller is separated from the second fuse the first fuse can be extracted together with the fuse puller. As a result, the first fuse which is no longer needed can be discarded easily together with the fuse puller.

DETAILED DESCRIPTION OF THE INVENTION

Embodiments of the present invention will now be described with reference to the drawings.

Figure 1:
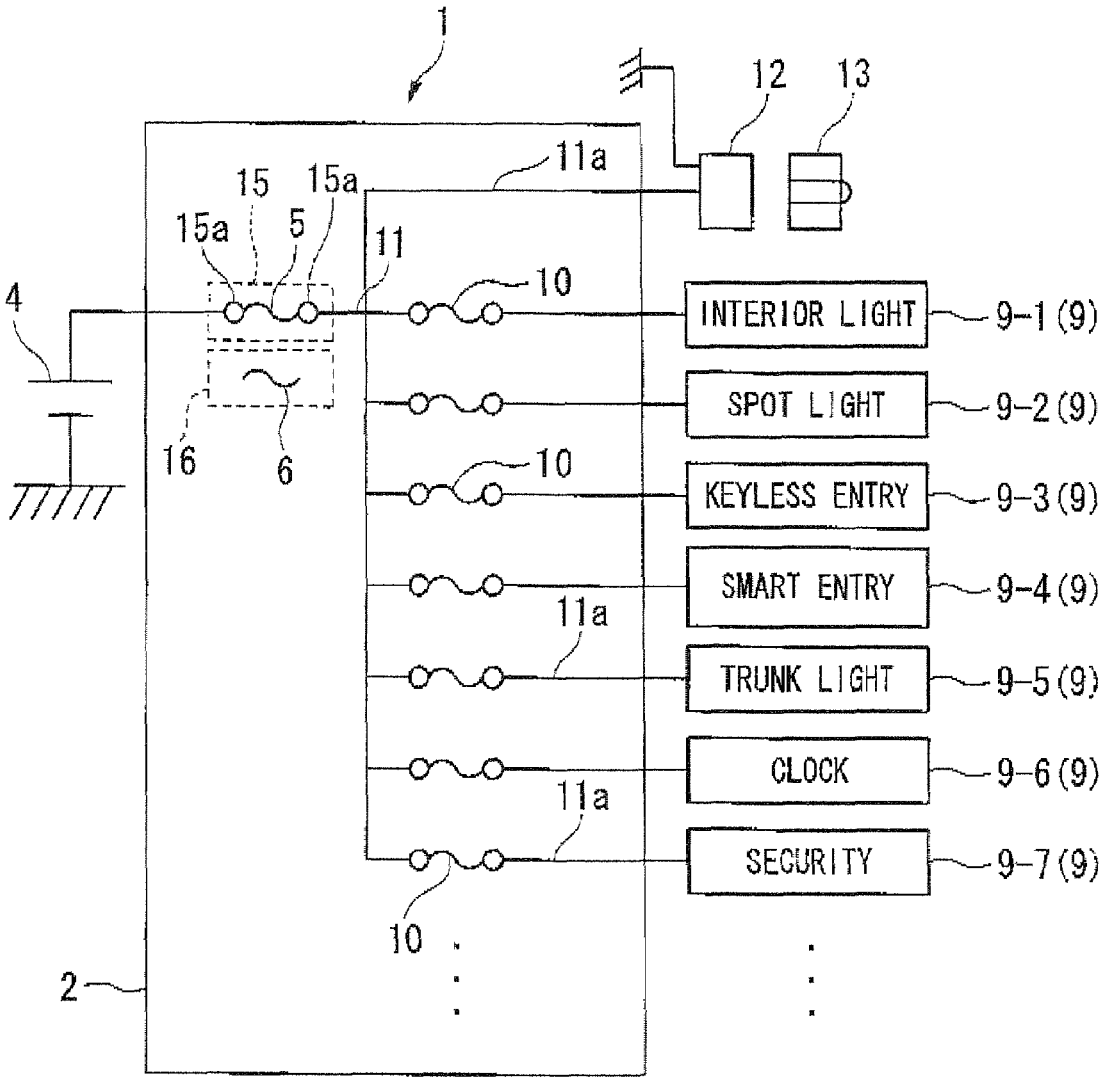
FIG. 1 is a circuit structural diagram of a fuse box.

FIG. 1 is a circuit structure diagram of a fuse box. A wire 11 that is provided in a battery 4 which serves as a power supply for a vehicle is branched into a plurality of wires 11*a* that are connected to a variety of on-board instruments 9. Fuses 10 are provided respectively in each one of the branched wires 11*a* in order to prevent overcurrent flowing into the respective on-board instruments 9. A first fuse 5 is provided on the unbranched wire 11 in order to prevent dark current flowing into the continuous operation on-board instruments.

The first fuse 5 is installed together with the respective fuses 10 in a fuse box 2. The first fuse 5 is detachably housed in a first housing portion 15 in the fuse box 2. Connection terminals 15*a* and 15*a* that are used to connect the first fuse 5 to the wire 11 are provided in the first housing portion 15. In addition, a second fuse 6 is detachably housed in a second housing portion 16 that is adjacent to the first housing portion 15. This second fuse 6 is not connected to the wire 11.

In contrast, the wire 11 is branched on the downstream side of the first housing portion 15, and leads to the outside of the fuse box 2 where it is connected to a connector 12. If a coupler 13 is installed in his connector 12, then the wire 11 on the downstream side of the first housing portion 15 can be grounded. As a result, overcurrent flows into the wire 11 and the first fuse 5 is melted.

Figure 2:
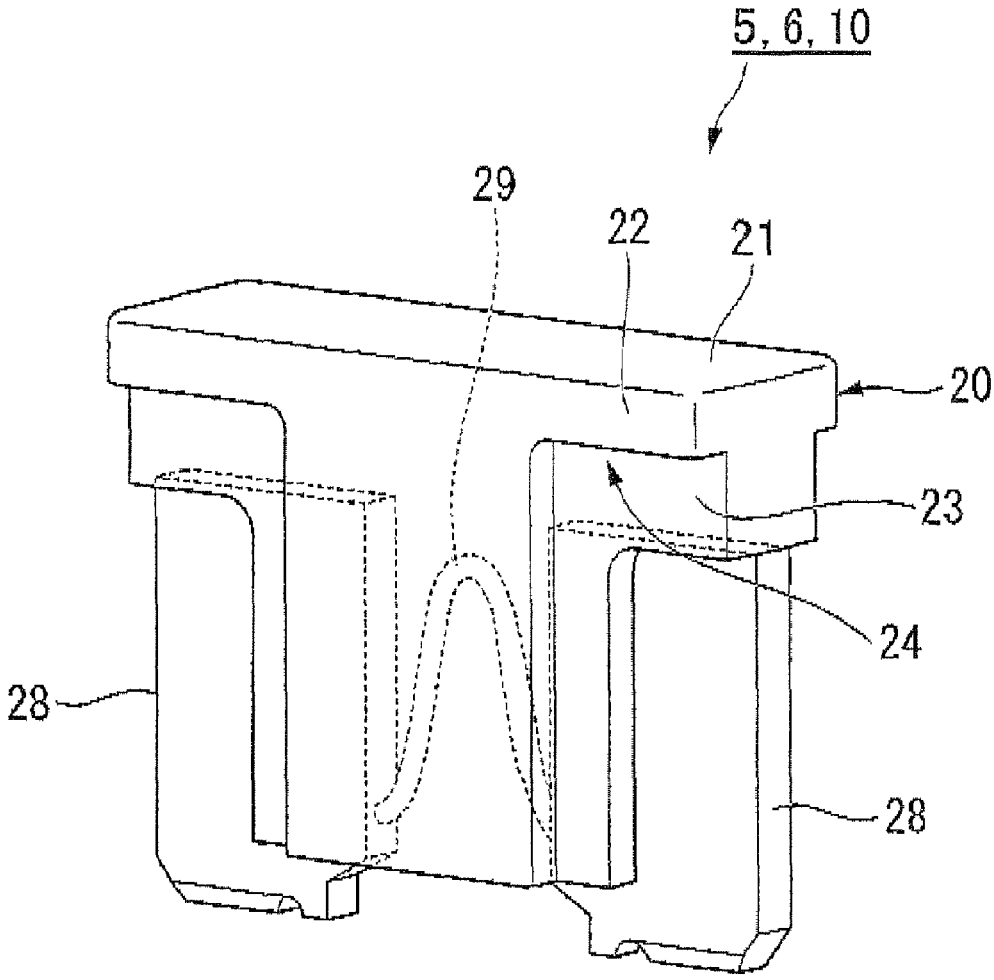
FIG. 2 is a perspective view of a fuse.

FIG. 2 is a perspective view of the fuse 10. The fuse 10 (the same applies for the first fuse 5 and the second fuse 6) is provided with a substantially T-shaped cover component 20, and with a pair of plate-shaped terminals 28 and 28 that protrude downwards from both sides of the cover component 20. A breaker wire 29 is connected between the pair of plate-shaped terminals 28 and 28. The hollow cover component 20 is provided so as to cover his wire 29. The cover component 20 is formed from a colored, transparent resin material. Because the cover component 20 is formed from a transparent material, whether or not the wire 29 inside it has been melted can be visually confirmed. Because the cover component 20 is formed from a colored material, it is possible to identify the attributes (i.e., the rated current and connected on-board instrument and the like) of the fuse 10. Identification symbols and the like may also be inscribed on a top surface 21 of the cover component.

The cover component 20 of the fuse 10 is provided with a substantially T-shaped wide portion 22, and narrow portions 23 that are formed at both sides of the wide portion 22. Engaging portions 24 are formed on both sides of the wide portion 22 by stepped portions formed between the wide portion 22 and the narrow portions 23.

Figure 3:
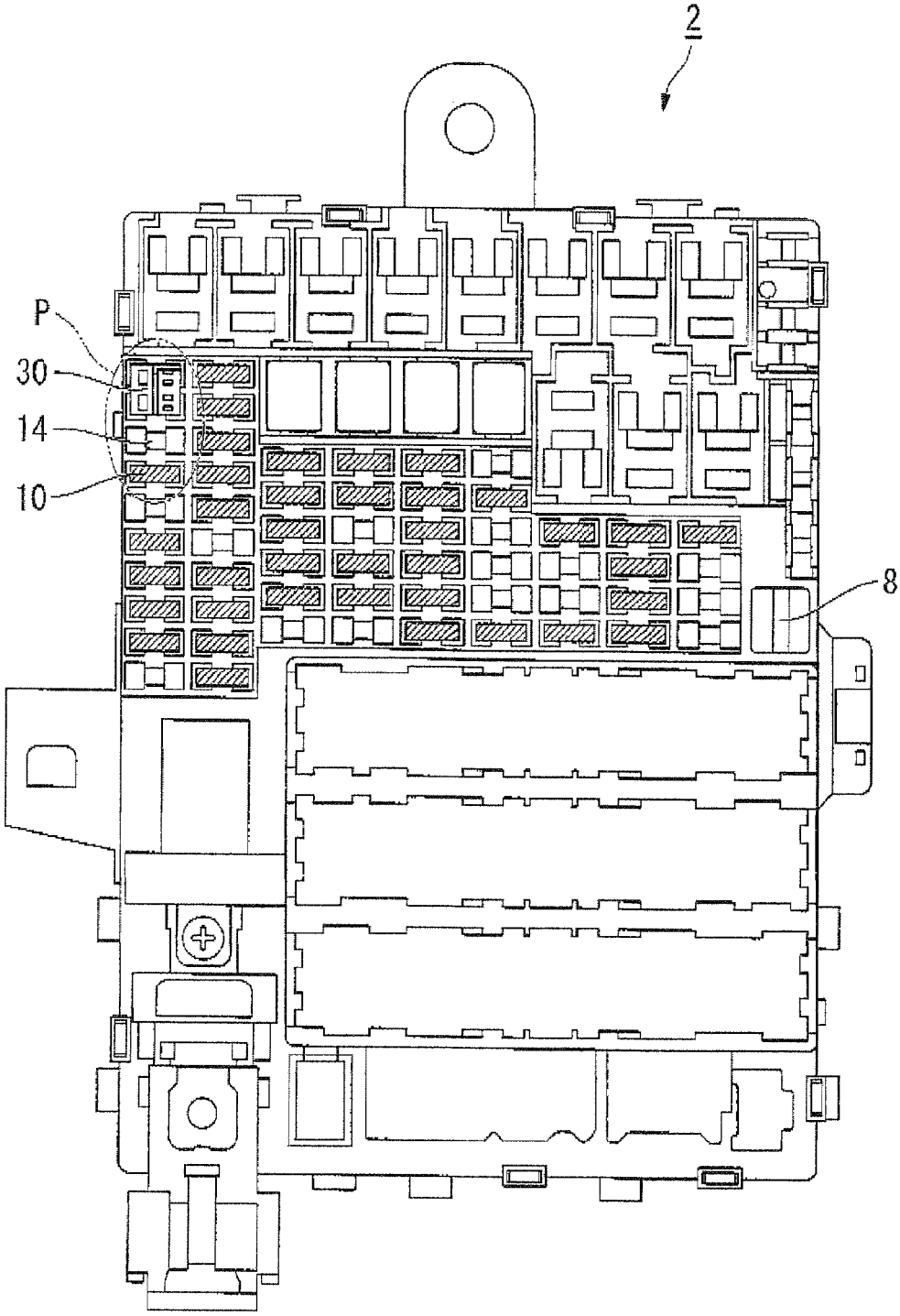
FIG. 3 is a front view of the fuse box.

FIG. 3 is a front view of the fuse box 2. A plurality of the fuses 10 are detachably housed respectively in individual housing portions 14 in the fuse box 2. In addition, a universal fuse puller 8 is fitted in the fuse box 2. The universal fuse puller 8 is used to detach the respective fuses 10 in the fuse box 2, and is formed in the shape of a clothes peg enabling it to hold individual fuses 10.

Figure 4:
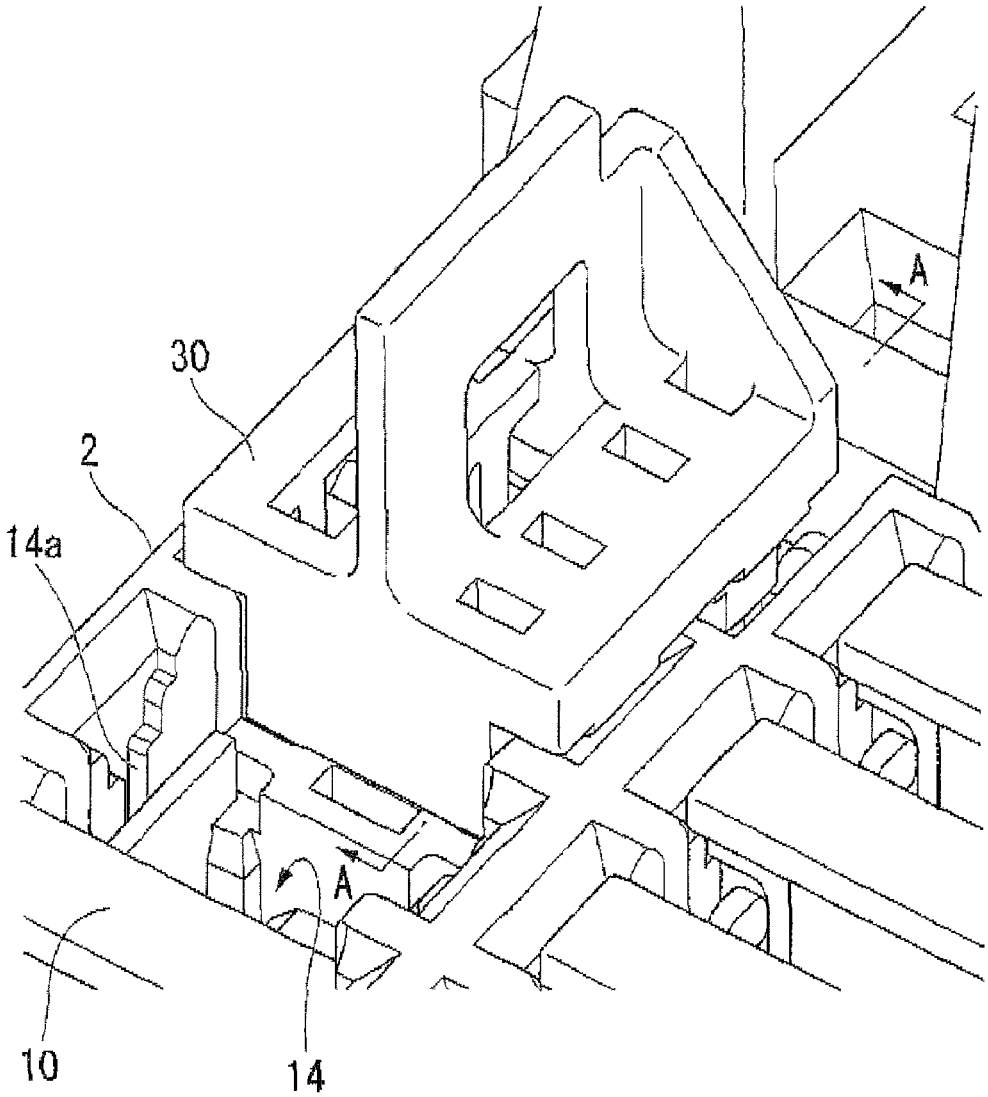
FIG. 4 is an enlarged perspective view of a portion P shown in FIG. 3.

FIG. 4 is an enlarged perspective view showing a portion P in FIG. 3. As is shown in FIG. 4, a groove-shaped connecting terminal (referred to below as a groove terminal) 14*a* is formed in a housing portion 14 in order to hold the above described plate-shaped terminals of the fuse 10. A plate-shaped terminal of the fuse 10 is held in the groove terminal 14*a* of the housing portion 14, and the fuse 10 is also detachably held in the housing portion 14.

First Embodiment

As is show in FIG. 4, a fuse puller 30 according to a first embodiment is fitted in the fuse box 2. The fuse puller 30 is fitted onto the first fuse 5 that is housed in the first housing portion and the second fuse 6 that is housed in the second housing portion.

Figure 5:
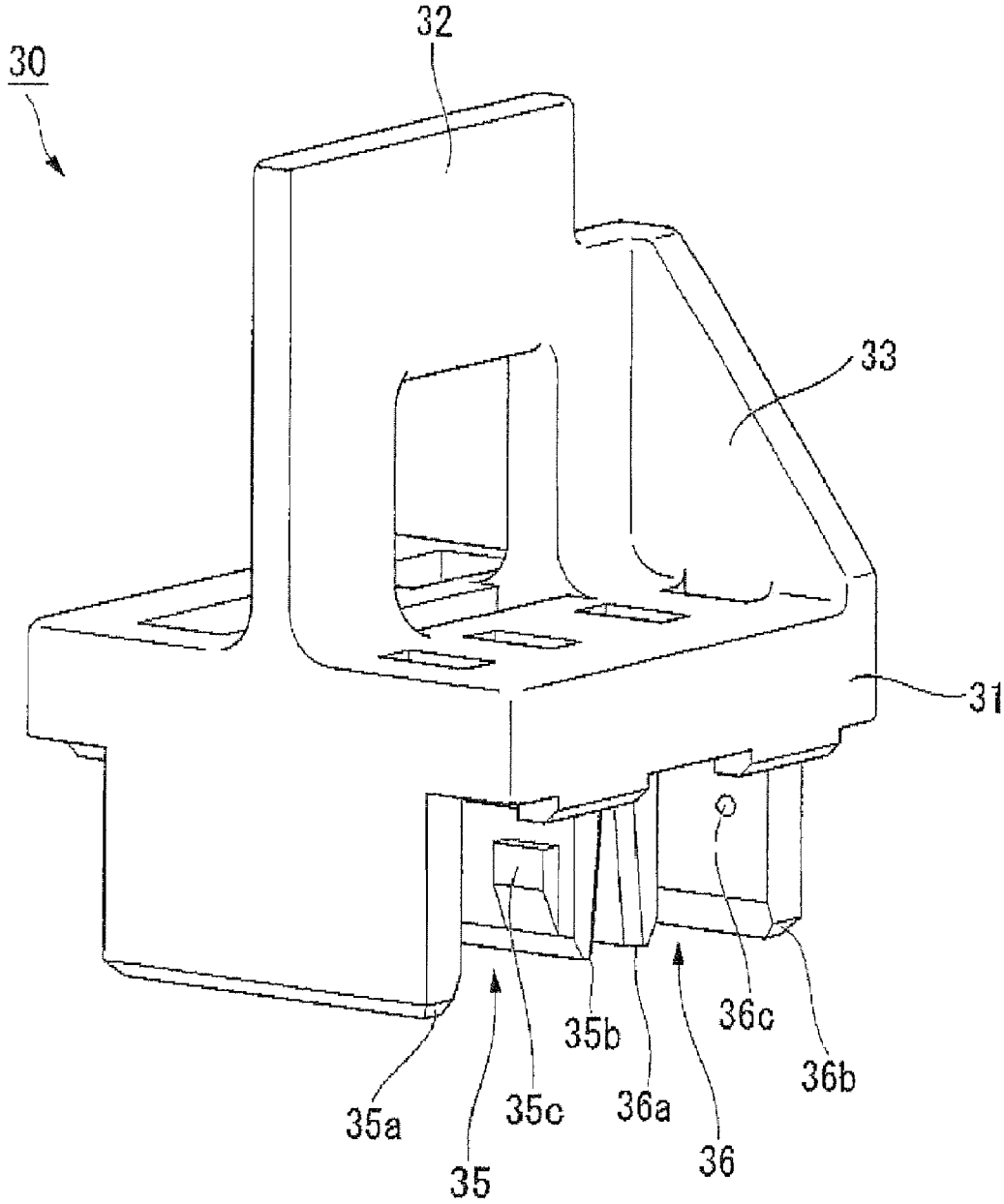
FIG. 5 is a perspective view of a fuse puller according to a first aspect of the present invention.

FIG. 5 is a perspective view of the fuse puller according to the first embodiment. The entire fuse puller 30 is formed from a resin material, and a rectangular plate-shaped base component 31 is provided in the center thereof. The base portion 31 is provided with a first holding portion 35, a gripping portion 32, and a second holding portion 36. Specifically, the plate-shaped gripping portion 32 is provided in a center portion on a top side (i.e., on another side) of the base component 31. In addition, a rib 33 is provided extending between an edge of the base component 31 and an edge of the gripping portion 32 so as to ensure sufficient strength in the gripping portion 32.

A first holding portion 35 that holds the first fuse 5 and a second holding portion 36 that holds the second fuse 6 are formed parallel to each other on a bottom side (i.e., on one side) of the base component 31.

The first holding portion 35 is provided with a pair of side walls 35*a* and 35*b* that are provided on the bottom surface of the base component 31. Outwardly protruding rectangular parallelepiped-shaped first engaging portions 35*c* are formed on an inner surface of each of the side walls 35*a* and 35*b*. An engaging portion of the first fuse 5 engages with a top side of the first engaging portions 35*c*, and the first fuse 5 is consequently held by the first holding portion 35. A bottom surface of each first engaging portion 35*c* is formed as a tapered surface so that the engaging portion of the first fuse 5 is guided to the top side of the first engaging portions 35*c*.

The second holding portion 36 is provided with a pair of side walls 36*a* and 36*b* that are provided on the bottom surface of the base component 31. Outwardly protruding semispherical second engaging portions 36*c* are formed on an inner surface of each of the side walls 36*a* and 36*b*. An engaging portion of the second fuse 6 engages with a top side of the second engaging portions 36*c*, and the second fuse 6 is consequently held by the second holding portion 36.

At least one of the width and the height of the semispherical second engaging portions 36*c* is smaller than the rectangular parallelepiped-shaped first engaging portions 35*c*. Consequently, the fuse holding strength of the second holding portion 36 is less than that of the first holding portion 35.

(Fuse Replacement Method)

Next, a description will be given of on-board instrument inspection, vehicle transporting, and fine replacement methods.

Firstly, as is shown in FIG. 1, on the inspection line of a vehicle manufacturer, the on-board instruments 9 are energized via the first fuse 5, and the on-board instruments 9 are then inspected. Once the inspections are ended, the coupler 13 is connected to the connector 12, and the first fuse 5 is melted. In this state, the vehicle is delivered from the manufacturers to the dealers. Accordingly, it is possible to prevent dark current flowing to the on-board instruments 9.

Next, at the dealers, the melted first fuse 5 that is housed in the first housing portion 15 of the fuse box 2 is replaced with the unmelted second fuse 6.

FIGS. 6 through 10 are process diagrams showing a fuse replacement method according to the first embodiment, and are cross-sectional views of a portion corresponding to a line A-A in FIG. 4.

Figure 6:
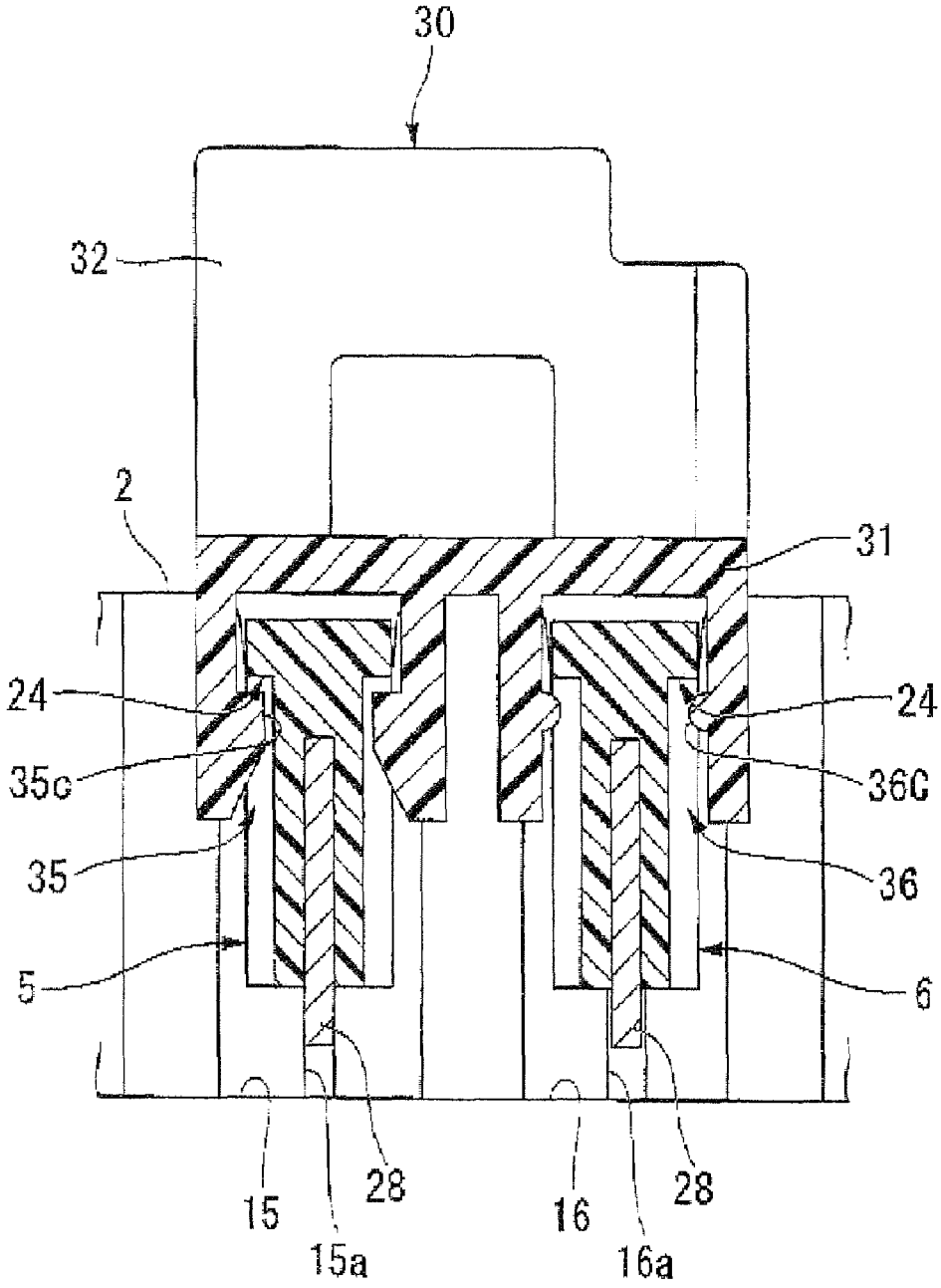
FIG. 6 is a view used to illustrate a fuse replacement process performed using the fuse puller.

As is shown in FIG. 6, the first fuse 5 is housed in the first housing portion 15 of the fuse box 2, and the second fuse 6 is housed in the second housing portion 16. Specifically, the plate-shaped terminals 28 of the first fuse 5 are held in a groove terminal 15*a* of the first housing portion 15 so that the first fuse 5 is held in the first housing portion 15. In contrast to this, the plate-shaped terminals 28 of the second fuse 6 are not held in the groove portion 16*a* of the second housing portion 16 so that the second fuse 6 is not held in the second housing portion 16. In this case as well, because the second fuse 6 is held on the bottom side of the fuse puller 30, the second fuse 6 is prevented from falling out.

The fuse puller 30 is fitted on the first fuse 5 and the second fuse 6. Specifically, the first engaging portions 35*c* of the first holding portion 35 of the fuse puller 30 engage with the engaging portions 24 of the first fuse 5, and the first holding portion 35 holds the first fuse 5. Moreover the second engaging portions 36*c* of the second holding portion 36 engage with the engaging portions 24 of the second fuse 6, and the second holding portion 36 holds the second fuse 6.

Figure 7:
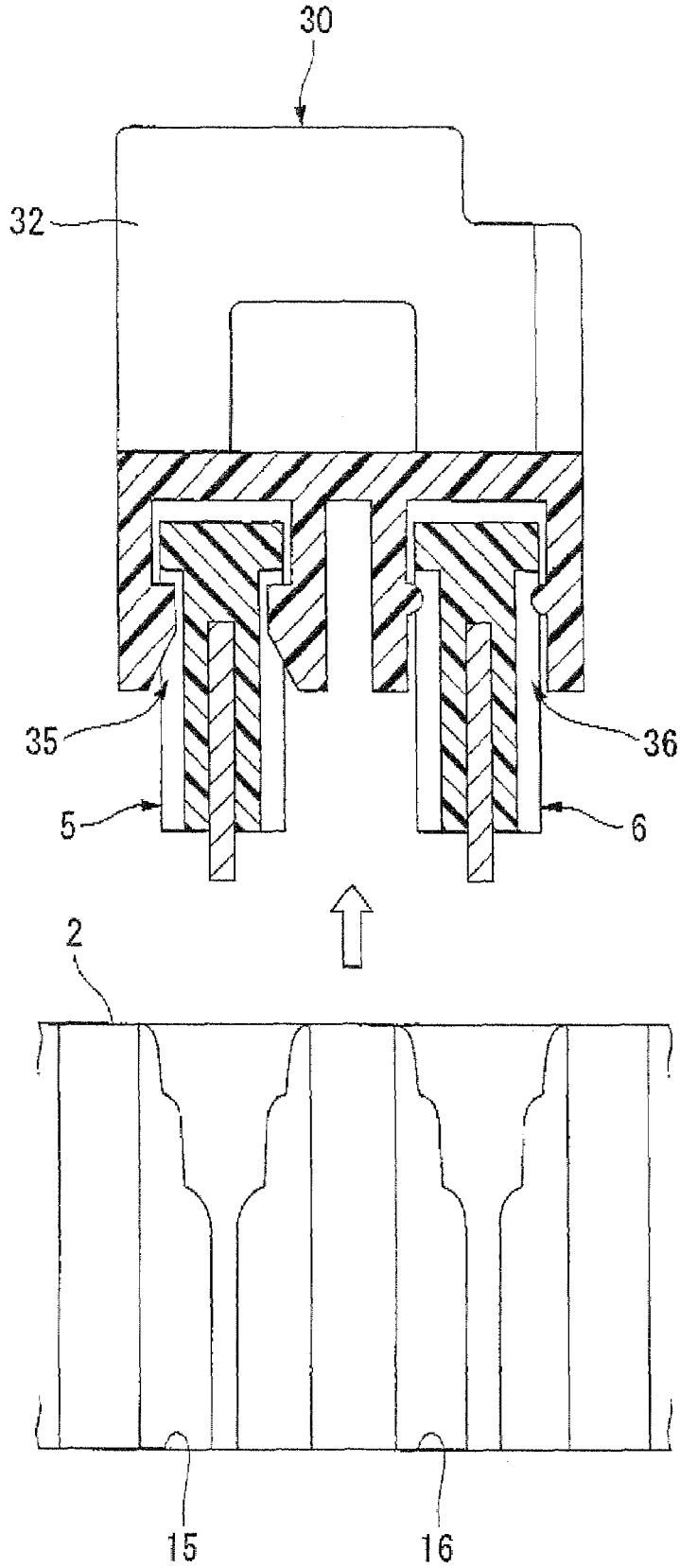
FIG. 7 is a view illustrating a continuation of the fuse replacement process.

Firstly, as is shown in FIG. 7, an operator grips the gripping portion 32 of the fuse puller 30 and extracts the first fuse 5 and second fuse 6 from the fuse box 2 together with the fuse puller 30. The holding force with which the first fuse 5 is held by the first holding portion 35 of the fuse puller 30 is set to be greater than the holding force with which the first fuse 5 is held in the first housing portion 15 of the fuse box 2. Because of this, it is possible to extract the first fuse 5 together with the fuse puller 30. Moreover, although the second holding portion 36 of the fuse puller 30 is holding the second fuse 6, the second housing portion 16 of the fuse box 2 is not holding the second fuse 6. As a result, the second fuse 6 is extracted together with the fuse puller 30.

Figure 8:
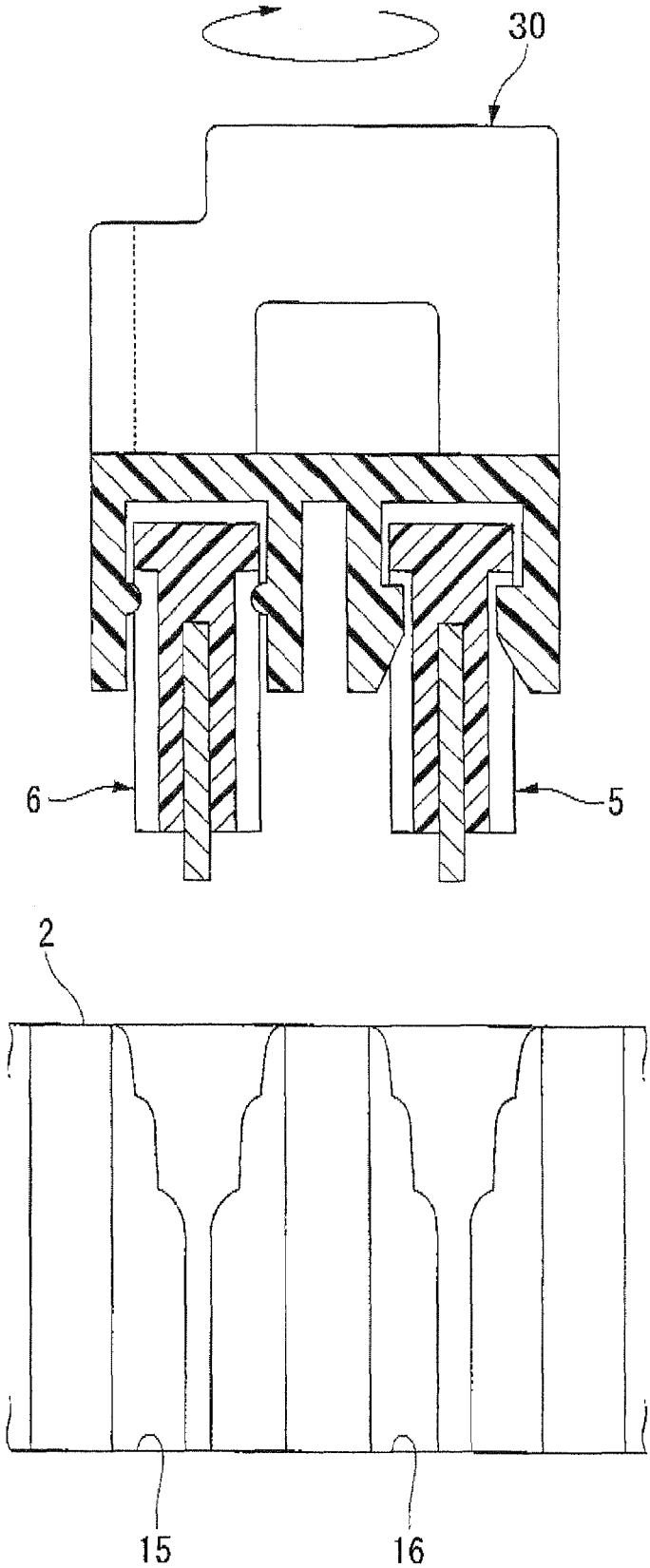
FIG. 8 is a view illustrating a continuation of the fuse replacement process.

Next, as is shown in FIG. 8, the fuse puller 30 is rotated 180 degrees within a horizontal plane that is parallel with the fuse box 2. As a result, the second fuse 6 is placed above the first housing portion 15 of the fuse box 2, and the first fuse 5 is placed above the second housing portion 16.

Figure 9:
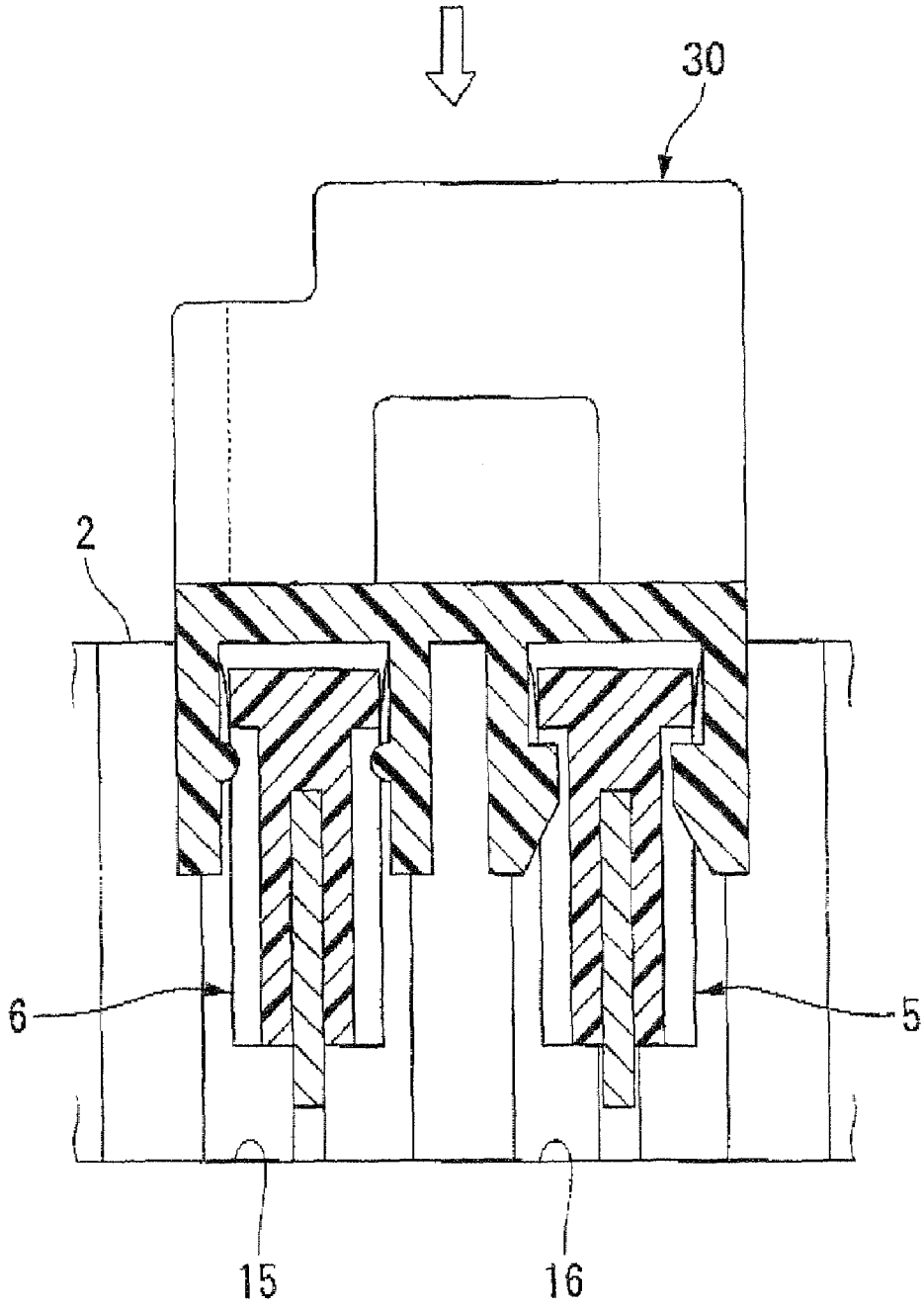
FIG. 9 is a view illustrating a continuation of the fuse replacement process.

Next, as is shown in FIG. 9, the use puller 30 is lowered so that the second fuse 6 is inserted into the first housing portion 15 of the fuse box 2, and the first fuse 5 is inserted into the second housing portion 16.

Figure 10:
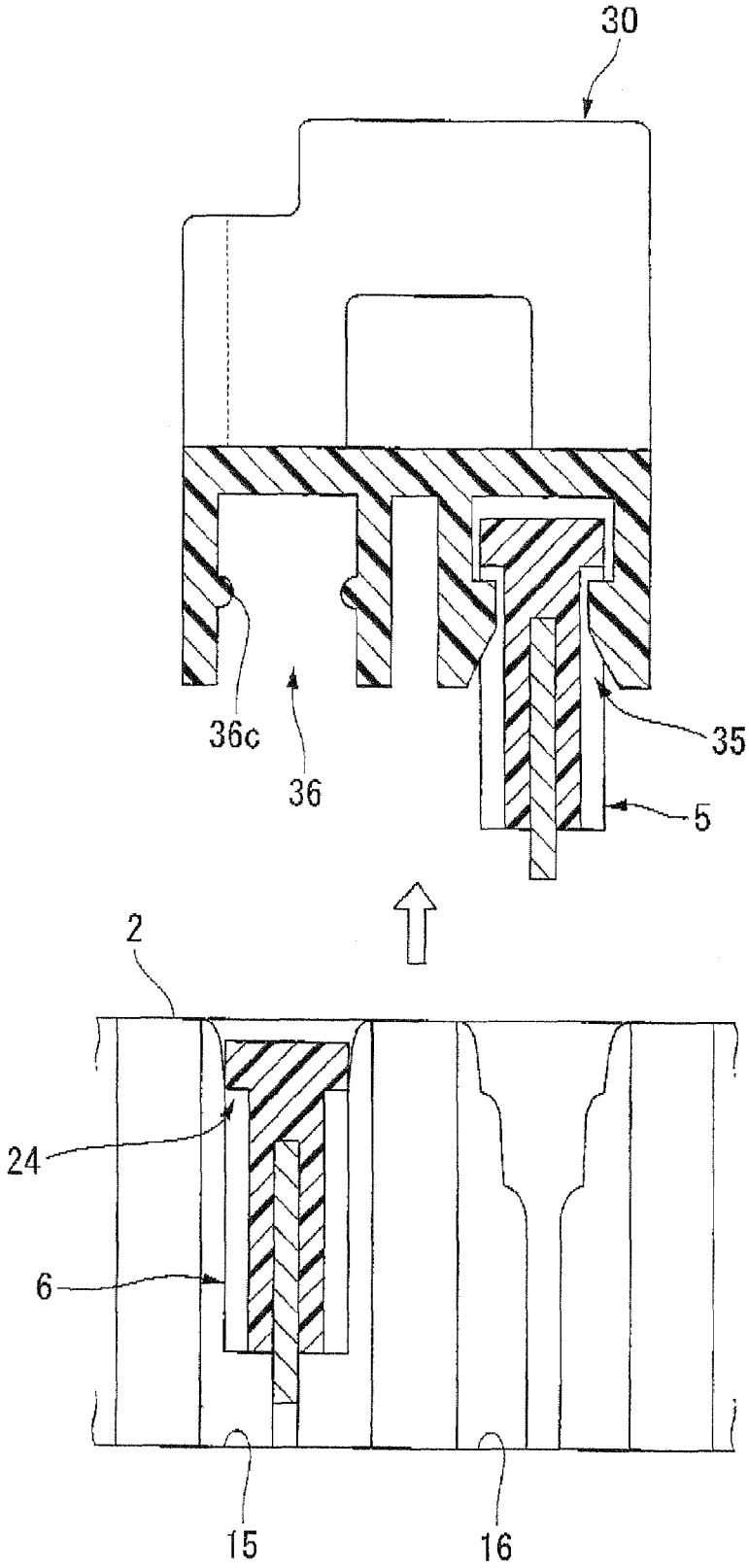
FIG. 10 is a view illustrating a continuation of the fuse replacement process.

Next, as is shown in FIG. 10, the fuse puller 30 is extracted once again. The holding force with which the second fuse 6 is held by the second holding portion 36 of the fuse puller 30 is set to be smaller than the holding force with which the second fuse 6 is held in the first housing portion 15 of the fuse box 2. Because of this, while the second fuse 6 remains held in the first housing portion 15, the engagement between the second engaging portions 36*c* of the second holding portion 36 and the engaging portion 24 of the second fuse 6 is released, and the fuse puller 30 is separated from the second fuse 6. As a result, the second fuse 6 can be left behind in the first housing portion 15. In contrast, although the first holding portion 35 of the fuse puller 30 is holding the first fuse 5, the second housing portion 16 of the fuse box 2 is not holding the first fuse 5. Consequently, the first fuse 5 can be extracted together with the fuse puller 30. The extracted first fuse 5 is discarded together with the fuse puller 30.

As a result of the above, as is shown in FIG. 1, the first fuse 5 that was fitted in the first housing portion 15 of the fuse box 2 can be replaced with the second fuse 6. This enables the on-board instruments 9 to be energized from the power supply 4 via the second fuse 6.

As has been described above in detail, a structure is employed in which the fuse puller 30 according to the first embodiment which is shown in FIG. 6 is also provided with the second holding portion 36 that holds the second fuse 6 in addition to being provided with the gripping portion 32 which is provided on the top side of the base component 31, and with the first holding portion 35 that holds the first fuse 5 and is formed on the bottom side of the base component 31.

According to this structure, because the gripping portion 32 is provided, it is possible to perform a fuse replacement task without using a tool or the like. Moreover, by installing the fuse puller 30 in advance on the first fuse 5, it is possible to accurately extract the first fuse 5 from among the plurality of fuses that are fitted in the fuse box 2. Furthermore, because it is possible to hold the second fuse 6 in the second holding portion 36, the second fuse 6 can be accurately selected and used to replace the first fuse 5.

Moreover, a structure is employed in which the second holding portion 36 is formed in parallel with the first holding portion 35 on the bottom side of the base component 31.

According to this structure, because the second fuse 6 is held on the bottom side of the base component 31, it is possible to prevent the second fuse 6 dropping out.

Moreover, a structure is employed in which the second holding portion 36 holds the second fuse 6 which is housed in the second housing portion 16 of the fuse box 2.

According to this structure, the first fuse 5 and the second fuse 6 are extracted from the fuse box 2 together with the fuse puller 30. The fuse puller 30 is rotated 180 degrees within a horizontal plane, the second fuse 6 is inserted into the first housing portion 15 by the fuse puller 30, and the fuse puller 30 is separated from the second fuse 6. As a result, it is possible to replace the first fuse 5 which is housed in the first housing portion 15 with the second fuse 6. In this manner, the task of replacing a fuse can be performed easily and reliably.

Moreover, a structure is employed in which a holding force F35 with which the first fuse 5 is held by the first holding portion 35 of the fuse puller 30 is greater than a holding force F15 with which the first fuse 5 is held in the first housing portion 15 of the fuse box 2, and in which a holding force F36 with which the second fuse 6 is held by the second holding portion 36 of the fuse puller 30 is greater than a holding force F16 with which the second fuse 6 is held in the second housing portion 16 of the fuse box 2. Namely, the following Formula (1) and Formula (2) are established.

$$F35>F15 \quad (1)$$

$$F36>F16 \quad (2)$$

According to this structure, as is shown in FIG. 7, it is possible to extract the first fuse 5 and the second fuse 6 from the fuse box 2 together with the fuse puller 30.

Moreover, a structure is employed in which the holding force F36 with which the second fuse 6 is held by the second holding portion 36 of the fuse puller 30 is smaller than the holding force F15 with which the second fuse 6 is held in the first housing portion 15 of the fuse box 2. Namely, the following Formula (3) is established.

$$F15>F36 \quad (3)$$

According to this structure, as is shown in FIG. 10, it becomes possible to separate the use puller 30 from the second fuse 6 simply by extracting the fuse puller 30 after the second fuse 6 has been inserted into the first housing portion 15 by the fuse puller 30. Accordingly, the task of replacing a fuse can be performed easily and reliably.

According to Formula (1) through Formula (3), the following Formula (4) can be established.

$$F35>F15>F36>F16 \quad (4)$$

Namely, if the above described structure is employed, the holding force F35 with which the first fuse 5 is held by the first holding portion 35 of the fuse puller 30 is greater than the holding force F16 with which the second fuse 6 is held in the second housing portion 16 of the fuse box 2. Because of this, at the same time as the fuse puller 30 is separated from the second fuse 6, the first fuse 5 can be extracted together with the fuse puller 30. As a result the first fuse 5 which is no longer needed can be discarded easily together with the fuse puller 30.

Moreover, in the first embodiment, because the second fuse 6 is housed in the second housing portion 16 of the fuse box 2, it is possible to automatically install the second fuse 6 in the fuse box 2 at the same time as the first fuse 5. Namely, it is sufficient if an assembly apparatus (step) of the fuse box 2 of the first embodiment has an apparatus (step) that automatically installs the first fuse 5 and the second fuse 6 in a fuse box, and an apparatus (step) that automatically installs the fuse puller 30 on the first fuse 5 and the second fuse 6. Accordingly, according to the first embodiment, it is possible to simplify the apparatus (process) for assembling the fuse box 2.

Second Embodiment

Figure 11:
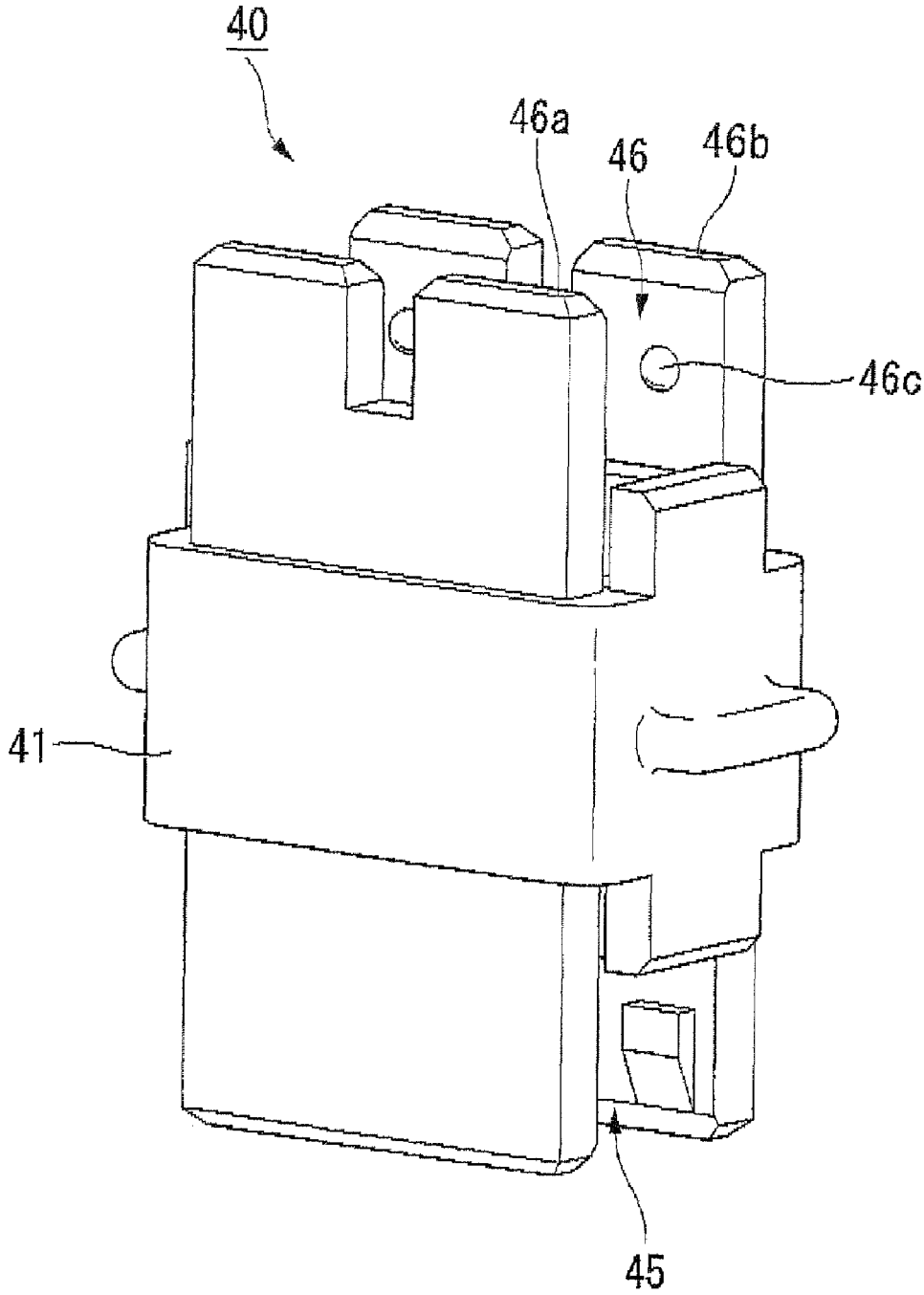
FIG. 11 is a perspective view of a fuse puller according to a second aspect of the present invention.

FIG. 11 is a perspective view of a fuse puller according to a second embodiment. The fuse puller according to the first embodiment has the first holding portion and the second holding portion formed parallel with each other on the bottom side of the base component, however, a fuse puller 40 according to the second embodiment differs from this in that a first holding portion 45 is formed on a bottom side of a base component 41, and a second holding portion 46 is formed on a top side of the base component 41. Any detailed description of portions having the same structure as in the first embodiment is omitted.

As is shown in FIG. 11, the base component 41 is provided in the center of the fuse puller 40. The holding portion 45, which is the same as in the first embodiment, is provided on the bottom side of the base component 41.

The second holding portion 46 is provided on the top side of the base component 41. The second holding portion 46 is provided with a pair of side walls **46*a* and 46*b* that are positioned on a top surface of the base component 41. Outwardly protruding semispherical second engaging portions 46*c* are formed on an inner surface of each of the side walls 46*a* and 46*b*. An engaging portion of the second fuse 6 engages with a bottom side of the second engaging portions 46*c*, and the second fuse 6 is consequently held by the second holding portion 46**.

Figure 12:
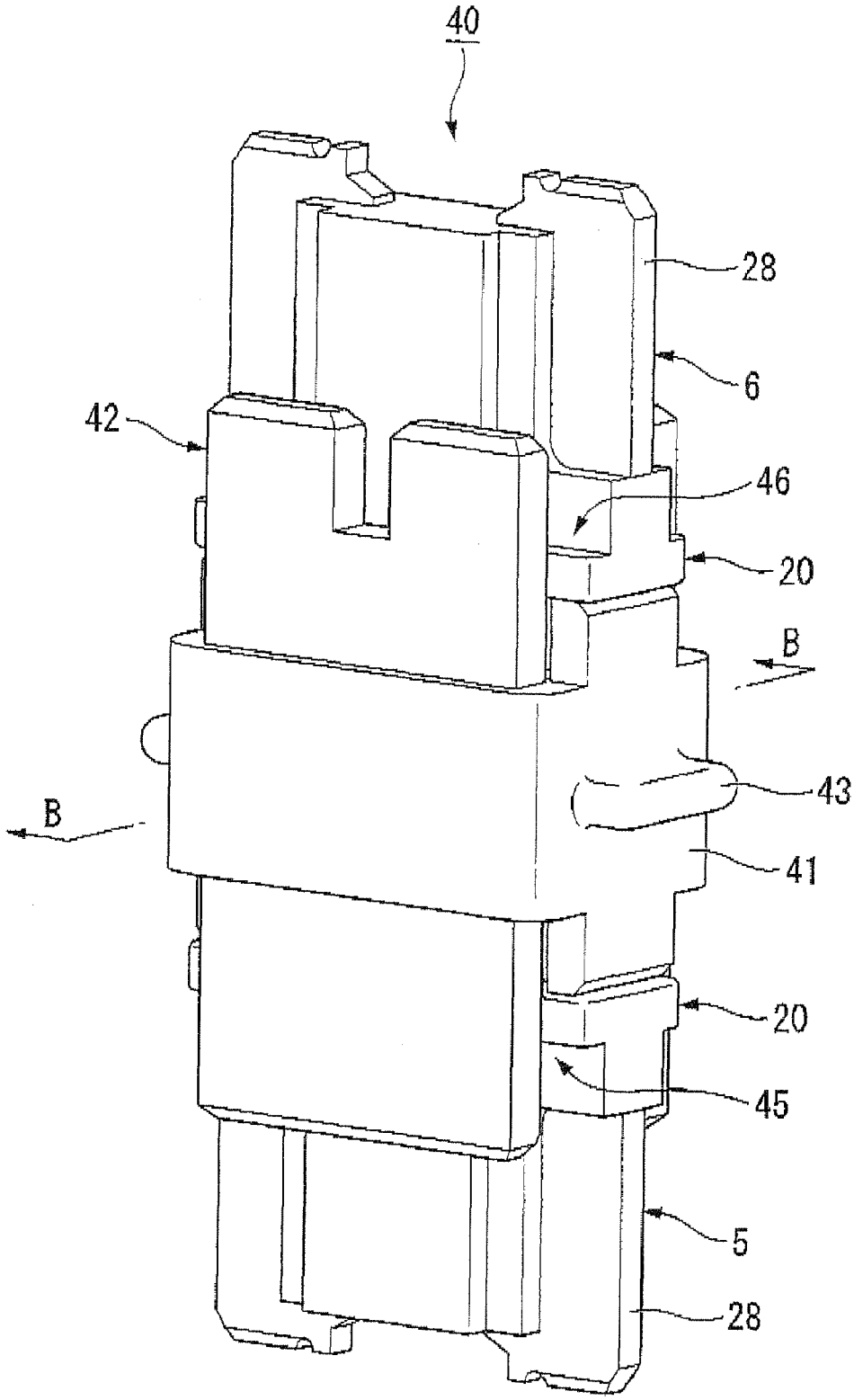
FIG. 12 is a perspective view showing the fuse puller holding a fuse.

FIG. 12 is a perspective view showing a fuse puller holding a fuse. The first fuse 5 is held in the first holding portion 45 with the top surface of the cover component 20 of the first fuse 5 facing a bottom surface of the base component 41 and with the plate-shaped terminals 28 of the first fuse 5 facing downwards. The second fuse 6 is held in the second holding portion 46 with the top surface of the cover component 20 of the second fuse 6 facing a top surface of the base component 41 and with the plate-shaped terminals 28 of the second fuse 6 facing upwards. Namely, the first fuse 5 and the second fuse 6 are held in the fuse puller 40 sandwiching the base component 41 and with their respective top surfaces facing back-to-back.

The second holding portion 46 which is formed on the top side of the base component 41 functions as a gripping portion 42 of the fuse puller 40. Projections 43 that are formed on side surfaces of the base component 41 also function as gripping portions of the use puller 40.

(Fuse Replacement Method)

Next, a method of replacing the melted first fuse 5 with the unmelted second fuse 6 will be described.

Figure 13:
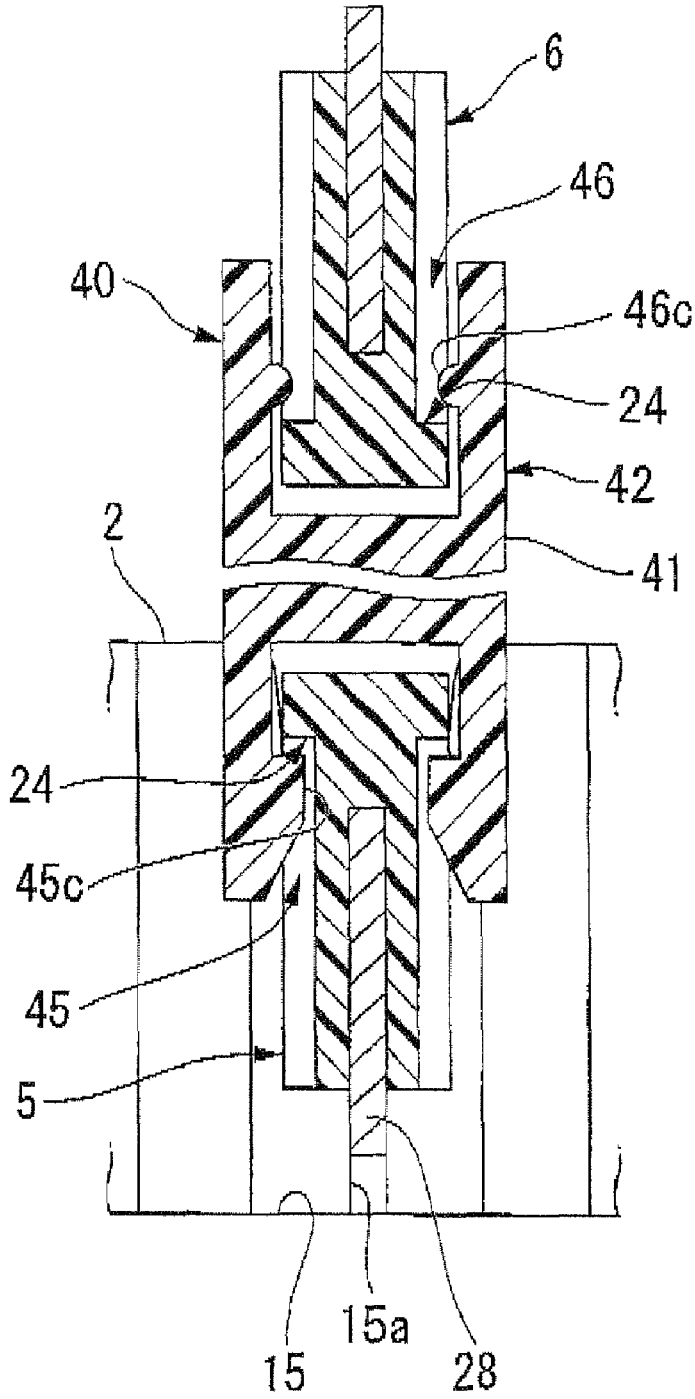
FIG. 13 is a view used to illustrate a fuse replacement process performed using the fuse puller.

FIGS. 13 through 17 are process diagrams showing a fuse replacement method according to the second embodiment, and are cross-sectional views of a portion corresponding to a line B-B in FIG. 12. As is shown in FIG. 13, the first fuse 5 is held in the first housing portion 15 of the fuse box 2, and the second fuse 6 is held in the second housing portion 46 of the fuse puller 40. Specifically, the plate-shaped terminals 28 of the first fuse 5 are held in the groove terminal 15*a* of the first housing portion 15, so that the first fuse 5 is held in the first housing portion 15.

The fuse puller 40 is fitted on the first fuse 5. Specifically, the first engaging portions 45*c* of the first holding portion 45 of the fuse puller 40 engage with the engaging portions 24 of the first fuse 5, and the first holding portion 45 holds the first fuse 5. Moreover, the second holding portion 46 of this same fuse puller 40 holds the second fuse 6. Specifically, the second engaging portions 46*c* of the second holding portion 46 engage with the engaging portions 24 of the second fuse 6, and the second holding portion 46 holds the second fuse 6.

Figure 14:
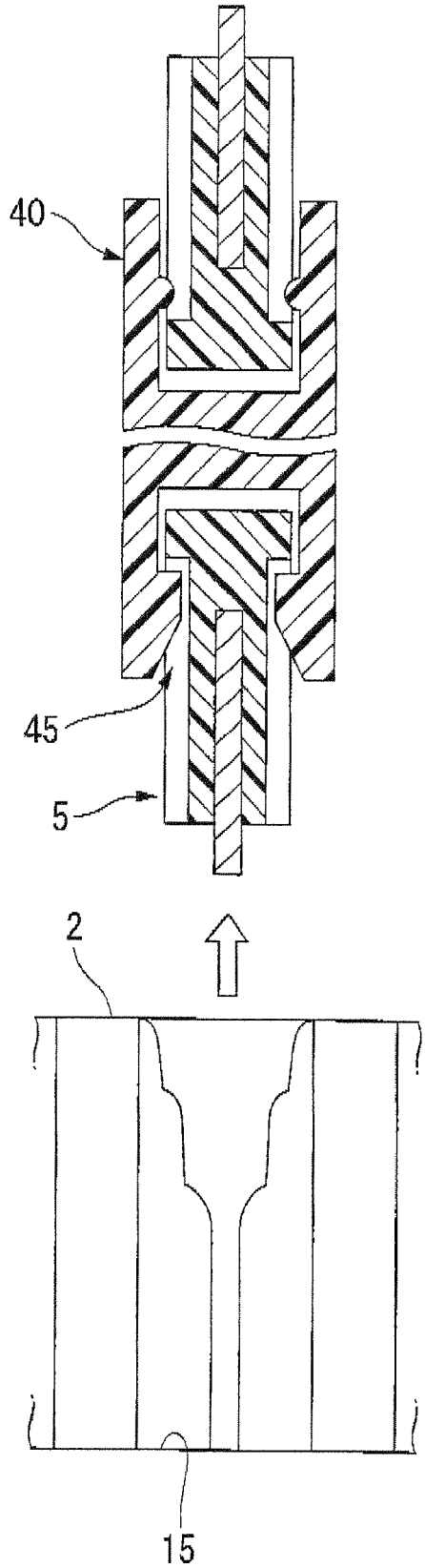
FIG. 14 is a view illustrating a continuation of the fuse replacement process.

Next, as is shown in FIG. 14, an operator grips fuse puller 40 and extracts the first fuse 5 from the fuse box 2 together with the fuse puller 40. The holding force with which the first fuse 5 is held by the first holding portion 45 of the fuse puller 40 is set to be greater than the holding force with which the first fuse 5 is held in the first housing portion 15 of the fuse box 2. Because of this, it is possible to extract the first fuse 5 together with the fuse puller 40.

Figure 15:
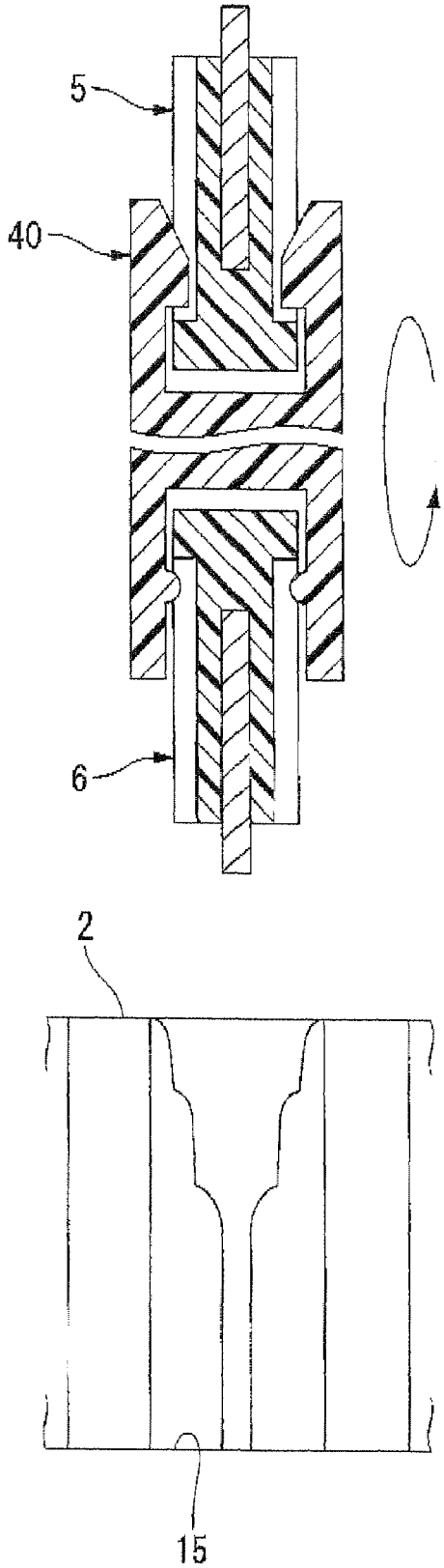
FIG. 15 is a view illustrating a continuation of the fuse replacement process.

Next, as is shown in FIG. 15, the fuse puller 40 is rotated 180 degrees within a plane that is perpendicular to the fuse box 2. As a result, the second fuse 6 which is being held in the fuse puller 40 is placed above the first housing portion 15 of the fuse box 2.

Figure 16:
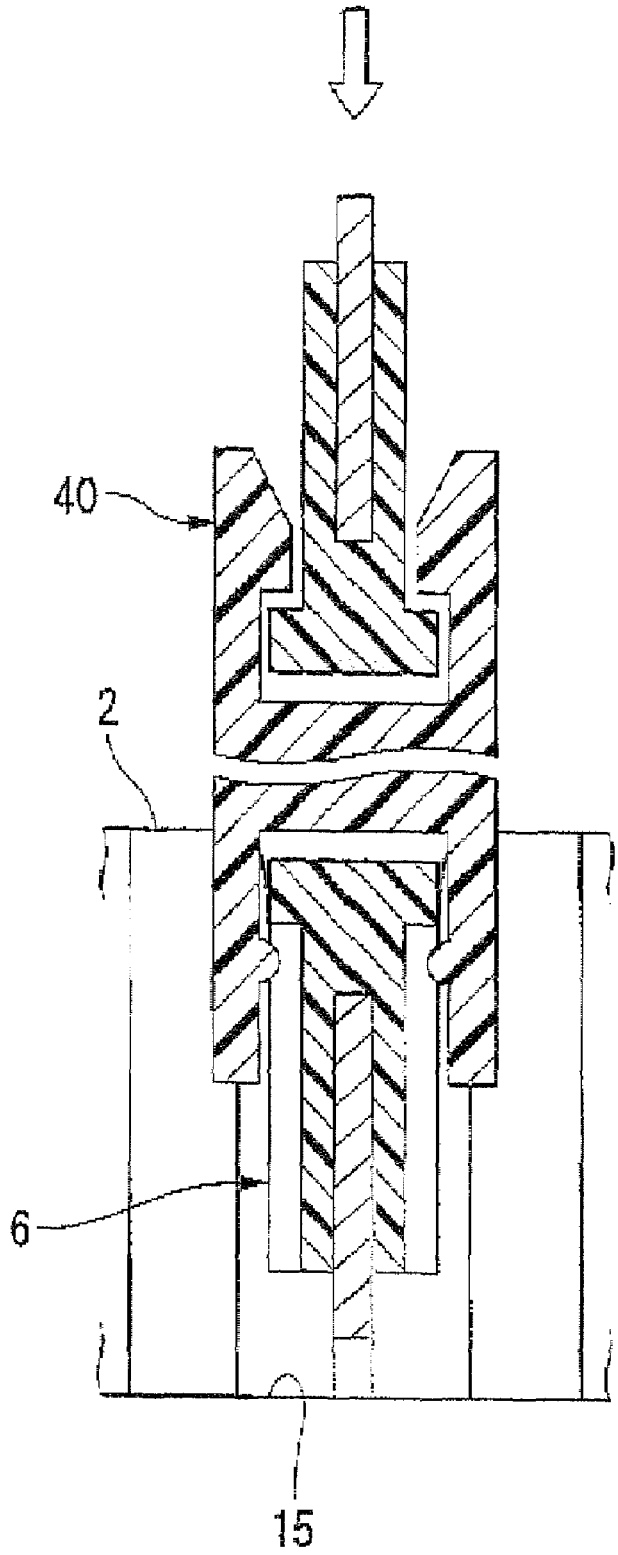
FIG. 16 is a view illustrating a continuation of the fuse replacement process.

Next, as is shown in FIG. 16, the fuse puller 40 is lowered so that the second fuse 6 is inserted into the first housing portion 15 of the fuse box 2.

Figure 17:
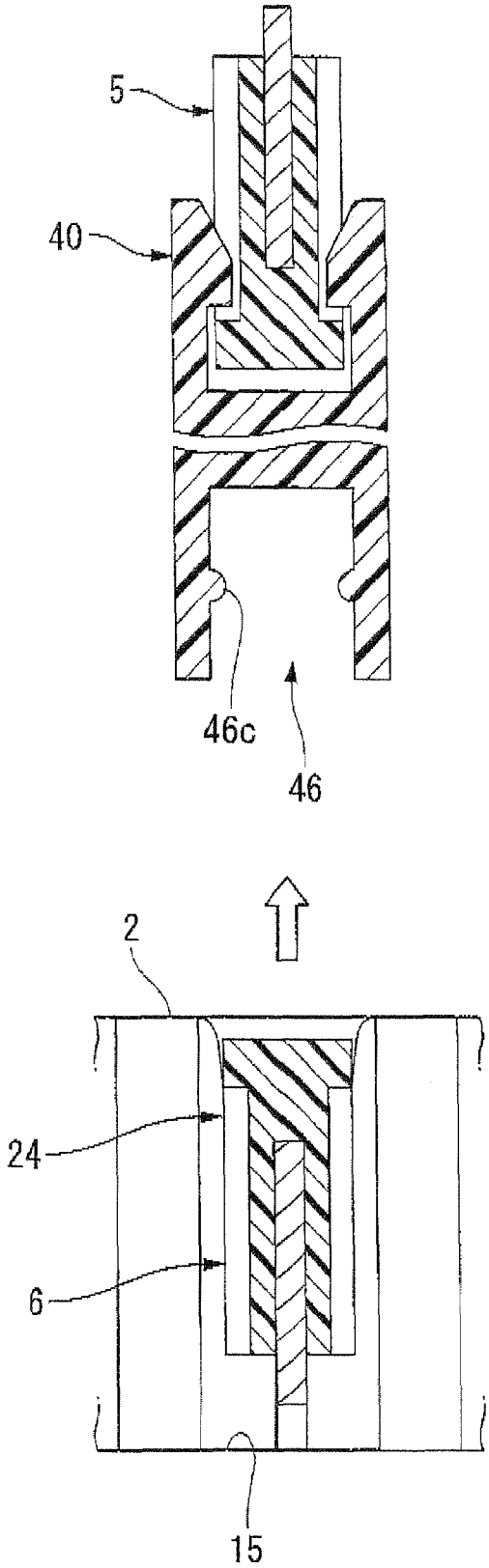
FIG. 17 is a view illustrating a continuation of the fuse replacement process.

Next, as is shown in FIG. 17, the fuse puller 40 is extracted once again. The holding force with which the second fuse 6 is held by the second holding portion 46 of the fuse puller 40 is set to be smaller than the holding force with which the second fuse 6 is held in the fast housing portion 15 of the fuse box 2. Because of this, while the second fuse 6 remains held in the first housing portion 15, the engagement between the second engaging portions 46*c* of the second holding portion 46 and the engaging portion 24 of the second fuse 6 is released, and the fuse puller 40 is separated from the second fuse 6. As a result, the second fuse 6 can be left behind in the first housing portion 15. The first fuse 5 which is being held in the fuse puller 40 is then discarded together with the fuse puller 40.

As a result of the above, the first fuse 5 that was fitted in the first housing portion 15 of the fuse box 2 can be replaced with the second fuse 6.

As is described in detail above, a structure is employed in which the fuse puller 40 according to the second embodiment which is shown in FIG. 13 is also provided with the second holding portion 46 that holds the second fuse 6 in addition to being provided with the gripping portion 42 which is formed on the top side of the base component 41, and with the first holding portion 45 that holds the first fuse 5 and is formed on the bottom side of the base component 41.

According to this structure, because the gripping portion 42 is provided, it is possible to perform a fuse replacement task without using a tool or the like. Moreover, by installing the fuse puller 40 in advance on the first fuse 5, it is possible to accurately extract the first fuse 5 from among the plurality of fuses that are fitted in the fuse box 2. Furthermore, because it is possible to hold the second fuse 6 in the second holding portion 46, the second fuse 6 can be accurately selected and used to replace the first fuse 5.

Moreover a structure is employed in which the second holding portion 46 that holds the second fuse 6 is formed in the gripping portion 42.

According to this structures because it is not necessary to provide the second holding portion 46 separately from the gripping portion 42, it is possible to reduce the required space. Moreover, because it is not necessary to provide space to house the second fuse 6 inside the fuse box 2, the size of the fuse box 2 can be reduced.

Moreover, a structure is employed in which the second holding portion 46 of the fuse puller 40 is formed such that the second fuse 6 can be inserted in the first housing portion 15 of the fuse box 2.

According to this structures the first fuse 5 is extracted from the fuse box 2 together with the fuse puller 40. The fuse puller 40 is rotated 180 degrees within a vertical plane, the second fuse 6 is inserted into the first housing portion 15 by the fuse puller 40, and the second fuse 6 is separated from the fuse puller 40. As a result, it is possible to replace the first fuse 5 which is housed in the first housing portion 15 with the second fuse 6. In this manner, the task of replacing a fuse can be performed easily and reliably.

Moreover, a structure is employed in which the holding force with which the second fuse 6 is held by the second holding portion 46 of the fuse puller 40 is smaller than the holding force with which the second fuse 6 is held in the first housing portion 15.

According to this structure, as is shown in FIG. 17, it becomes possible to separate the fuse puller 40 from the second fuse 6 simply by extracting the fuse puller 40 after the second fuse 6 has been inserted into the first housing portion 15 by the fuse puller 40. Accordingly, the task of replacing a fuse can be performed easily and reliably.

Third Embodiment

Figure 18:
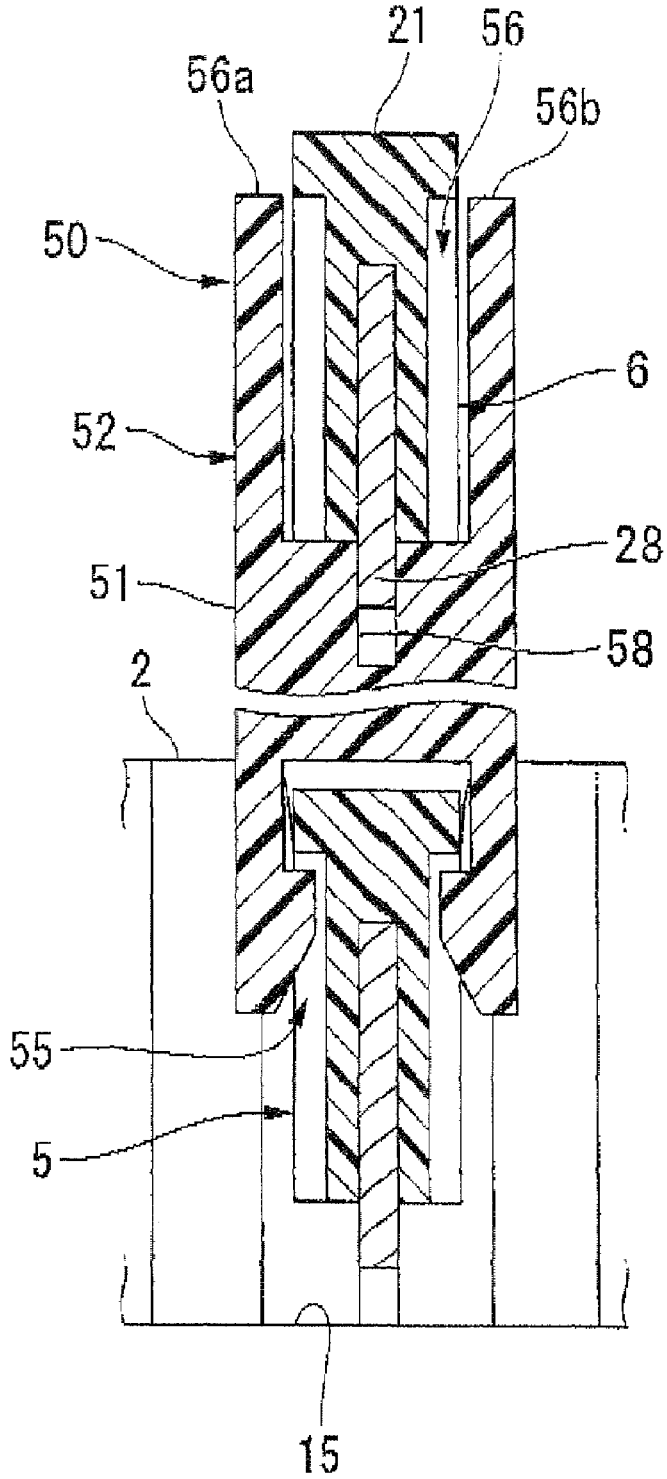
FIG. 18 is a vertical cross-sectional view of a fuse puller according to a third aspect of the present invention.

FIG. 18 is a side cross-sectional view of a fuse puller according to a third embodiment. In the second embodiment, the second fuse 6 is held facing in the opposite direction to the first fuse 5, however, the third embodiment differs from the second embodiment in that the second fuse 6 is held facing in the same direction as the first fuse 5. Any detailed description of portions having the same structure as in the first and second embodiments is omitted.

As is shown in FIG. 18, a first holding portion 55, which is the same as in the first embodiment, is provided on a bottom side of a base component 51 of a fuse puller 50.

In addition, a second holding portion 56 is provided on the top side of the base component 51. The second holding portion 56 is provided with a pair of side walls 56*a* and 56*b* that are positioned on a top surface of the base component 51. No second engaging portions are formed on inner surfaces of the side walls 56*a* and 56*b*. Instead of this, a groove portion 58 that holds the plate-shaped terminals 28 of the second fuse 6 is provided on a top surface of the base component 51 between the pair of side walls 56*a* and 56*b*.

In the second holding portion 56, the plate-shaped terminals 28 of the second fuse 6 are held in the groove portion 58 in the top surface of the base component 51, and the second fuse 6 is held with the top surface 21 of the cover component of the second fuse 6 facing upwards. Namely, the first fuse 5 and the second fuse 6 are held in the same attitude in the fuse puller 50. The second holding position 56 that is formed on the top side of the base component 51 functions as a gripping portion 52 of the fuse puller 50.

(Fuse Replacement Method)

Next, a method of replacing the melted first fuse 5 with the unmelted second fuse 6 will be described.

Firstly, an operator grips the fuse puller 50 and extracts the first fuse 5 from the fuse box 2 together with the fuse puller 50. The holding force with which the first fuse 5 is held by the first holding portion 55 of the fuse puller 50 is set so as to be greater than the holding force with which the first fuse 5 is held in the first housing portion 15 of the fuse box 2. Because of this, it is possible to extract the first fuse 5 together with the fuse puller 50.

Next the second fuse 6 is removed from the second holding portion 56 of the fuse puller 50, and is inserted into the first housing portion 15. The removal and insertion of the second fuse 6 may be performed directly by hand by an operator, or may be performed using the aforementioned universal fuse puller. The first fuse 5 that is being held in the fuse puller 50 is then discarded together with the fuse puller 50.

By performing the above procedure, it is possible to replace the first fuse 5 which is housed in the first housing portion 15 of the fuse box 2 with the second fuse 6.

As has been described in detail above, a structure is employed in which the fuse puller 50 according to the third embodiment is also provided with the second holding portion 56 that holds the second fuse 6 in addition to being provided with the gripping portion 52 which is formed on the top side of the base component 51, and with the first holding portion 55 that holds the first fuse 5 and is formed on the bottom side of the base component 51.

According to this structure, because the gripping portion 52 is provided, it is possible to perform a fuse replacement task without using a tool or the like. Moreover, by installing the fuse puller 50 in advance on the first fuse 5, it is possible to accurately extract the first fuse 5 from among the plurality of fuses that are fitted in the fuse box 2. Furthermore, because it is possible to hold the second fuse 6 in the second holding portion 56, the second fuse 6 can be accurately selected and used to replace the first fuse 5.

Moreover, a structure is employed in which the second holding portion 56 that holds the second fuse 6 is formed in the gripping portion 52.

According to this structure, because it is not necessary to provide the second holding portion 56 separately from the gripping portion 52, it is possible to reduce the required space.

The present invention is not limited to the above described embodiments.

For example, the shapes of the fuses described in the above embodiments are merely examples thereof, and the present invention can also be applied when other fuse shapes are used. Moreover, the shapes of the fuse housing portions described in the above embodiments are merely examples thereof, and the present invention can also be applied when other shapes are used. Furthermore, the shape of the fuse pullers of the present invention may be a different shape from those described in the above embodiments provided that such shapes do not depart from the spirit of the present invention.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A fuse puller, comprising:

a base component having a body;

a first holding portion extending in a first direction away from the body of the base component, the first direction being orthogonal relative to the body of the base component, wherein the first holding portion is configured to hold a first fuse and comprises:

first and second arms extending in a substantially parallel manner from the body of the base component, each of the first and second arms having an end face located at an end of a longitudinal axis thereof, the end faces of the first and second arms being orthogonal relative to the longitudinal axis of the first and second arms, and;

first and second engaging portions extending away from an inner face of the first and second arms and toward the other arm of the first holding portion, the first and second engaging portions being located intermediate the end face of each respective arm and the body of the base component relative to the longitudinal axis;

a gripping portion; and a second holding portion extending away from the body of the base component and configures to hold a second fuse, wherein the second holding portion comprises:

first and second arms extending in a substantially parallel manner from the body of the base component, each of the first and second arms having an end face located at an end of a longitudinal axis thereof, the end faces of the first and second arms being orthogonal relative to the longitudinal axis of the first and second arms, and;

first and second engaging portions extending away from an inner face of the first and second arms and toward the other arm of the second holding portion, the first and second engaging portions being located intermediate the end face of each respective arm and the body of the base component relative to the longitudinal axis, wherein at least one of a width and a height of the first and second engaging portions of the second holding portion is smaller than at least one of a width and a height of the first and second engaging portions of the first holding portion, and wherein a holding force with which the second fuse is held by the first and second engaging portions of the second holding portion is less than a holding force with which the first fuse is held by the first and second engaging portions of the first holding portion.

2. The fuse puller according to claim 1, wherein the second holding portion extends in a second direction away from the body of the base component, the second direction being opposite the first direction.

3. A fuse puller, comprising:

a base component having a body;

a first holding portion extending in a first direction away from the body of the base component, the first direction being orthogonal relative to the body of the base component, wherein the first holding portion is configured to hold a first fuse and comprises:

first and second arms extending in a substantially parallel manner from the body of the base component, each of the first and second arms having an end face located at an end of a longitudinal axis thereof, the end faces of the first and second arms being orthogonal relative to the longitudinal axis of the first and second arms, and;

first and second engaging portions extending away from an inner face of the first and second arms and toward the other arm of the first holding portion, the first and second engaging portions being located intermediate the end face of each respective arm and the body of the base component relative to the longitudinal axis;

a gripping portion; and a second holding portion extending away from the body of the base component and configures to hold a second fuse, wherein the second holding portion extends in the first direction away from the body of the base component and is parallel relative to the first holding portion.

* * * * *